US010422549B2

(12) United States Patent
Luo et al.

(10) Patent No.: US 10,422,549 B2
(45) Date of Patent: Sep. 24, 2019

(54) MOVEMENT MECHANISM, PANEL MECHANISM AND HOUSEHOLD APPLIANCE

(71) Applicant: Gree Electric Appliances, Inc. of ZHUHAI, Zhuhai, Guangdong (CN)

(72) Inventors: Hai Luo, Guangdong (CN); Zhi Meng, Guangdong (CN); Yupeng Huang, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 390 days.

(21) Appl. No.: 15/306,161

(22) PCT Filed: Apr. 2, 2015

(86) PCT No.: PCT/CN2015/075800
§ 371 (c)(1),
(2) Date: Oct. 24, 2016

(87) PCT Pub. No.: WO2015/161738
PCT Pub. Date: Oct. 29, 2015

(65) Prior Publication Data

US 2017/0045260 A1 Feb. 16, 2017

(30) Foreign Application Priority Data

Apr. 24, 2014 (CN) ..... 2014 1 0171397

(51) Int. Cl.
*F24F 13/06* (2006.01)
*F24F 13/20* (2006.01)
(Continued)

(52) U.S. Cl.
CPC ..... *F24F 13/20* (2013.01); *F24F 1/0011* (2013.01); *F24F 13/06* (2013.01);
(Continued)

(58) Field of Classification Search
CPC ..... F24F 13/20; F24F 13/06
(Continued)

(56) References Cited

U.S. PATENT DOCUMENTS 4,173,845 A * 11/1979 Heesch ..... E05F 11/382 49/350
4,949,651 A * 8/1990 Frank ..... G07F 7/005 109/24.1
(Continued)

FOREIGN PATENT DOCUMENTS

CN 2800137 Y 7/2006
CN 201944995 U 8/2011
(Continued)

OTHER PUBLICATIONS

China Patent Office, First Search Report regarding China Patent application No. 2014101713970.
(Continued)

*Primary Examiner* — David J Teitelbaum
(74) *Attorney, Agent, or Firm* — Li & Cai Intellectual Property (USA) Office

(57) ABSTRACT

The invention discloses a movement mechanism for a panel mechanism of a household appliance wherein, the movement mechanism includes: a rotary disc (21), rotatably provided, a first support (22) is fixedly provided on the rotary disc (21), and a free end of the first support (22) having a first connection portion; and a second support (23), the second support (23) and the rotary disc (21) being hinged to a second connection portion, a first end of the second support (23) having a third connection portion, and the third connection portion being movable along a predetermined track when the rotary disc (21) rotates.

18 Claims, 10 Drawing Sheets

(51) Int. Cl.
*F24F 13/14* (2006.01)
*F24F 1/0011* (2019.01)

(52) U.S. Cl.
CPC ..... *F24F 13/1426* (2013.01); *F24F 13/1486* (2013.01); *F24F 2013/1446* (2013.01); *F24F 2013/1473* (2013.01); *F24F 2221/26* (2013.01)

(58) Field of Classification Search
USPC ..... 74/25; 49/81.1, 130, 201, 197, 226, 232, 49/236, 246, 252, 340, 342, 261, 254, 49/257, 258, 250, 209–212, 221–223, 49/374, 249, 333, 389, 405, 40–41, 339
See application file for complete search history.

(56) References Cited

U.S. PATENT DOCUMENTS

| | | | | |
|---|---|---|---|---|
| 5,782,688 | A * | 7/1998 | Baek | F24F 1/0011 454/233 |
| 6,554,696 | B2 * | 4/2003 | Kowalski | B60H 1/00742 454/155 |
| 8,226,183 | B2 * | 7/2012 | Kang | E05D 3/022 16/362 |
| 8,904,709 | B2 * | 12/2014 | Ajiki | E05C 17/32 312/319.2 |
| 2001/0039762 | A1 * | 11/2001 | Giovannetti | E05F 1/1091 49/246 |
| 2014/0097730 | A1 * | 4/2014 | Kim | F24F 1/0014 312/236 |

FOREIGN PATENT DOCUMENTS

| | | | | |
|---|---|---|---|---|
| CN | 203024367 | U | 6/2013 | |
| CN | 203215868 | U | 9/2013 | |
| CN | 103335389 | A | 10/2013 | |
| CN | 203258820 | U | 10/2013 | |
| CN | 203797898 | U | 8/2014 | |
| EP | 2184559 | A1 | 5/2010 | |
| EP | 2241832 | A1 | 10/2010 | |
| EP | 3330630 | A1 * | 6/2018 | F24F 13/14 |
| JP | 2007170788 | A | 7/2007 | |
| WO | WO 2013031317 | A1 | 3/2013 | |

OTHER PUBLICATIONS

China Patent Office, second Search Report regarding China Patent application No. 2014101713970.
European Patent Office, European search report regarding application 15782793.2 dated Dec. 1, 2017.

* cited by examiner

MOVEMENT MECHANISM, PANEL MECHANISM AND HOUSEHOLD APPLIANCE

TECHNICAL FIELD OF THE INVENTION

The invention relates to the technical field of household appliances, and in particular to a movement mechanism, a panel mechanism and a household appliance.

BACKGROUND OF THE INVENTION

In the prior art, in a common household appliance, instanced by an air conditioner, a panel is unmovable generally. Recently, along with the design diversification of the air conditioner, an air conditioner with a movable panel begins to emerge. For example, in the technical solution disclosed by a Chinese patent file (publication number: CN203258820U), the panel is movable, such that when the air conditioner does not run, an air deflector is shielded by the panel, thereby achieving the appearance integrity. Besides, the movable panel can totally seal an air guide mechanism in a cavity formed by the panel and a housing, thereby avoiding a problem of influence on the health of a user caused by easy gathering of dust due to exposure of the air guide mechanism in air.

However, a movement mechanism for the panel is relatively complicated and is inconvenient to produce and process, the production cost of a household appliance is increased, and meanwhile, movement is unstable due to a complicated structure.

SUMMARY OF THE INVENTION

The invention is intended to provide a movement mechanism having a simple structure, a panel mechanism and a household appliance.

To this end, according to one aspect of the invention, a movement mechanism is provided, which comprises: a rotary disc, rotatably provided, a first support is fixedly provided on the rotary disc, and a free end of the first support having a first connection portion; and a second support, the second support and the rotary disc being hinged to a second connection portion, a first end of the second support having a third connection portion, and the third connection portion being movable along a predetermined track when the rotary disc rotates.

Furthermore, a guide piece is provided on the second support. The movement mechanism further comprises a drive box. The rotary disc is rotatably provided in the drive box. A first guide groove is provided on the drive box, wherein, the guide piece moving in the first guide groove so as to limit a movement track of the second support.

Furthermore, the guide piece is a rolling device or a guide shaft or may include a guide shaft and an axle sleeve sleeved outside the guide shaft.

Furthermore, a second end of the second support is further provided with a balance portion.

Furthermore, the guide piece is provided on the balance portion.

Furthermore, an obtuse angle is formed between a central axis of the balance portion and a central axis of the second support.

Furthermore, a second guide groove matching with the balance portion is provided on the rotary disc.

Furthermore, the drive box comprises a box body and a box cover fastened mutually, and the first guide groove is provided on the box cover.

Furthermore, a central through hole is provided at a rotation centre position of the rotary disc, and a central limiting shaft matching the central through hole is provided on the box body.

Furthermore, a middle limiting shaft is provided on the box body, the rotary disc has a first arc-shaped avoidance groove matching the middle limiting shaft, and a circle centre of the first arc-shaped avoidance groove is concentric with a rotation centre of the rotary disc.

Furthermore, the rotary disc is provided with an arc-shaped edge, a circle centre of the arc-shaped edge is concentric with a rotation centre of the rotary disc, an edge limiting shaft is provided on the box body, and the edge limiting shaft matches the arc-shaped edge of the rotary disc.

Furthermore, the rotary disc comprises a rotary disc body and a supporting portion provided on the periphery of the rotary disc body, arc-shaped supporting convex ribs are provided on the box body and/or the box cover, and the supporting portion and the arc-shaped supporting convex ribs match each other so as to support the rotary disc body away from the box body and/or the box cover.

Furthermore, the first end of the second support has a bending portion, and the third connection portion is provided on the bending portion.

Furthermore, a transmission rack is provided on the rotary disc, the movement mechanism further comprises a motor and a transmission mechanism, the motor drives the transmission mechanism, the transmission mechanism comprises a speed-reducing gear set, the transmission rack matches the speed-reducing gear set, and the motor drives the transmission mechanism so as to drive the rotary disc to rotate.

Furthermore, the speed-reducing gear set comprises a first gear and a second gear driven by the first gear, the radius of the first gear is smaller than that of the second gear, the first gear is mounted on an output shaft of the motor, and the second gear is meshed with the transmission rack.

Furthermore, the speed-reducing gear set further comprises a third gear which is coaxial with or integrated with the second gear, the third gear and the second gear rotating synchronously. The third gear is meshed with the first gear, and the radius of the second gear is smaller than that of the third gear.

Furthermore, the rotary disc has an arc-shaped drive groove, a circle centre of the arc-shaped drive groove is concentric with a rotation centre of the rotary disc, the transmission rack is provided in the arc-shaped drive groove, and the second gear rotates in the arc-shaped drive groove.

Furthermore, the rotary disc also has a second arc-shaped avoidance groove avoiding the motor.

Furthermore, the arc-shaped drive groove and the second arc-shaped avoidance groove are independent of each other, or the arc-shaped drive groove and the second arc-shaped avoidance groove are communicated with each other.

Furthermore, the movement mechanism of the invention further comprises a limiting rib protruding out of the drive box and corresponding to the second support, the limiting rib being configured to limit movement of the second support in a direction vertical to a rotation plane thereof.

Furthermore, the movement mechanism of the invention further comprises a connection piece, a first guide groove is provided on the connection piece so as to form the predetermined track, the first end of the second support is provided with a first matching portion sliding or rolling in the first guide groove, the first matching portion forms the third connection portion, and the connection piece is further provided with a hinging portion hinging the free end of the first support to the first connection portion.

According to another aspect of the invention, the invention also provides a panel mechanism, which comprises a panel and a movement mechanism matching the panel, the movement mechanism being the above movement mechanism.

Furthermore, a second guide groove is provided on the panel so as to form the predetermined track, the first end of a second support is provided with a second matching portion sliding or rolling in the second guide groove, the second matching portion forms the third connection portion, and the panel and the free end of a first support are hinged to the first connection portion.

According to another aspect of the invention, the invention also provides a panel mechanism, which comprises a panel and a movement mechanism matching the panel, the movement mechanism being the above movement mechanism. The panel is detachably connected with the connection piece.

According to another aspect of the invention, the invention also provides a household appliance, which comprises a housing and a panel mechanism mounted on the housing, the panel mechanism being the above movement mechanism.

Furthermore, the household appliance is an air conditioner, the air conditioner further comprises an air deflector, and a panel has a closed position covering the outer side of the air deflector and an open position exposed from the air deflector.

By adoption of the technical solution of the invention, when in use, a driven piece (such as a panel) and a movement mechanism are connected to a first connection portion and a third connection portion. The first connection portion is rotatably connected with the driven piece, and the third connection portion is movable with respect to a guide structure such as a guide groove forming a predetermined track. A first support is fixedly connected with a rotary disc, the first connection portion of the first support is hinged to the driven piece, and therefore rotation of the first support can push the driven piece hinged to the first support to rotatably move up and down. A second support and the rotary disc are hinged to the second connection portion, a first end of the second support has the third connection portion, during rotation of the first support, the second support will be driven to swing about the second connection portion serving as the rotation centre, and the third connection portion will be driven to move along the predetermined track. Thus, the driven piece connected with the movement mechanism is movable along a preset movement track. The movement mechanism of the invention enables the driven piece to move along the predetermined track by means of matching of the rotary disc, the first support and the second support. Compared with a dual-gear rack structure in the prior art, the movement mechanism of the invention has a simpler structure and more steadily moves.

BRIEF DESCRIPTION OF THE DRAWINGS

The drawings of the specification, forming a part of the invention, are intended to provide further understanding of the invention. The schematic embodiments and illustrations of the invention are intended to explain the invention, and do not form improper limits to the invention. In the drawings.

Wherein, the foregoing drawings include the following drawing marks:

10, panel; 11, second guide groove; 21, rotary disc; 211, arc-shaped drive groove; 213, first arc-shaped avoidance groove; 212, second arc-shaped avoidance groove; 214, supporting portion; 215, second guide groove; 216, transmission rack; 22, first support; 23, second support; 231, second matching portion; 232, balance portion; 232*a*, guide piece; 24, first gear; 25, second gear; 26, third gear; 27*a*, box body; 27*b*, box cover; 271, first guide groove; 272, arc-shaped supporting convex rib; 273, limiting rib; 281, central limiting shaft; 282, middle limiting shaft; 283, edge limiting shaft; 30, air deflector; 40, air sweeping blade; 50, connection piece; 51, first guide groove; 52, hinging portion; and 60, motor.

DETAILED DESCRIPTION OF THE EMBODIMENTS

It is important to note that the embodiments of the invention and the characteristics in the embodiments may be combined under the condition of no conflicts. The invention will be elaborated below with reference to the drawings and in conjunction with the embodiments.

Figure 1:
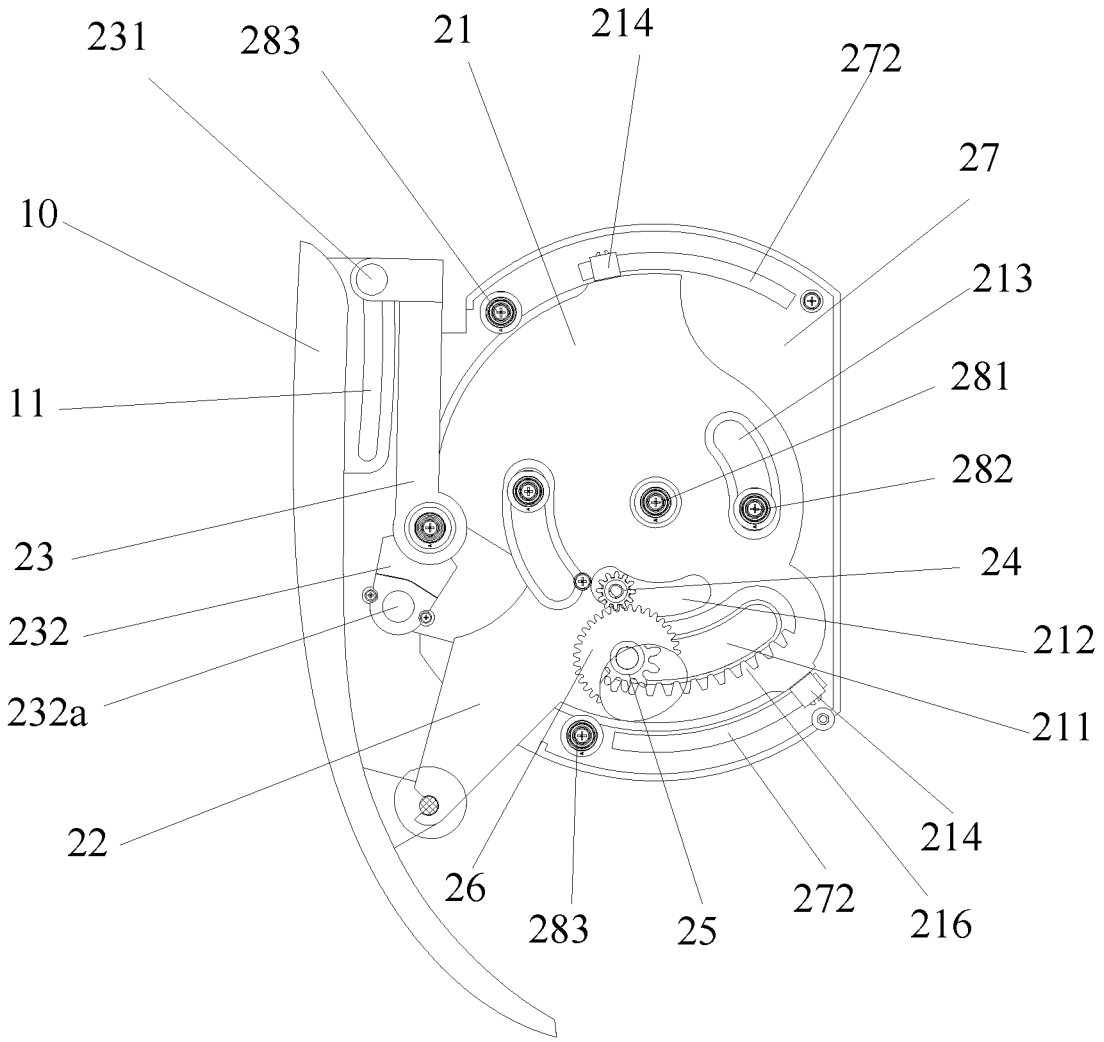
FIG. 1 shows a partial structure diagram of a movement mechanism at a closed position according to an embodiment 1 of the invention.
Figure 2:
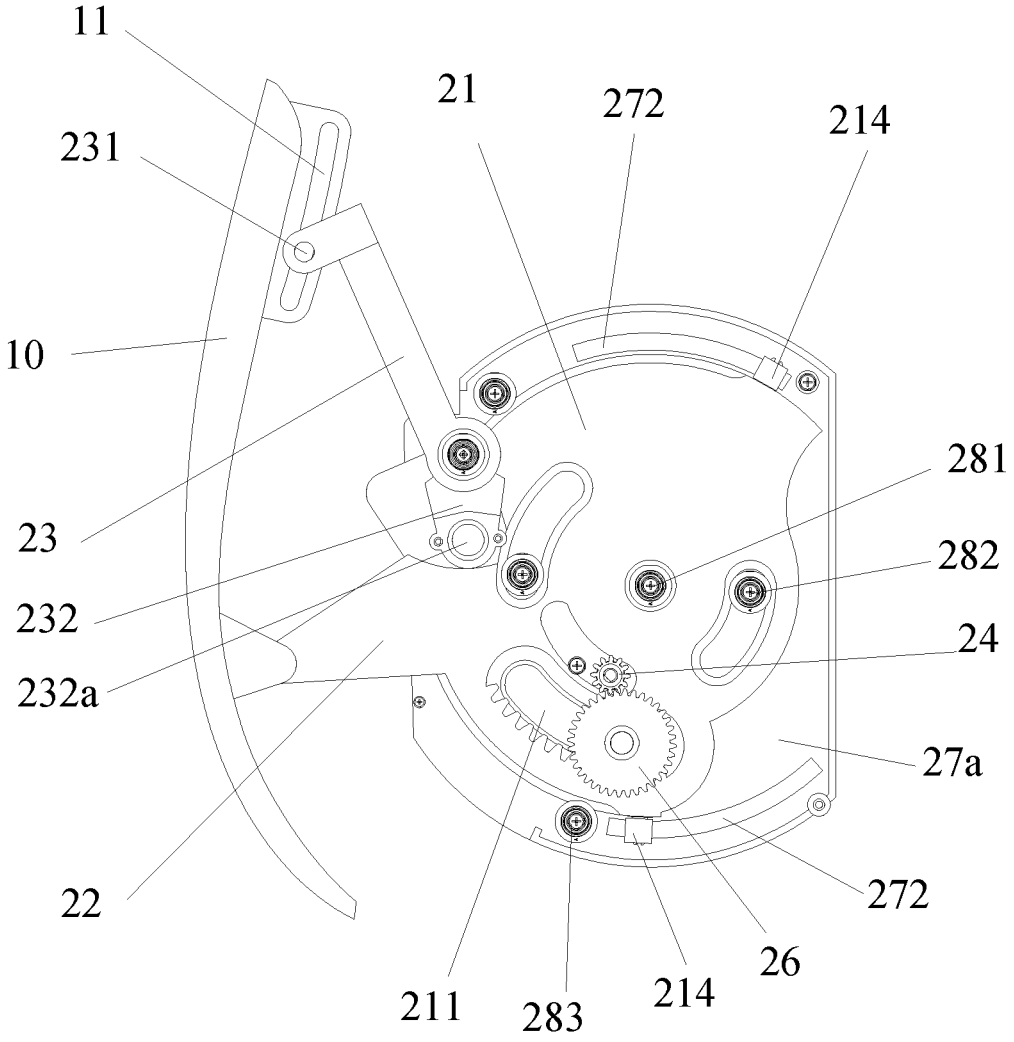
FIG. 2 shows a structural diagram of a movement mechanism of FIG. 1 at an open position.
Figure 3:
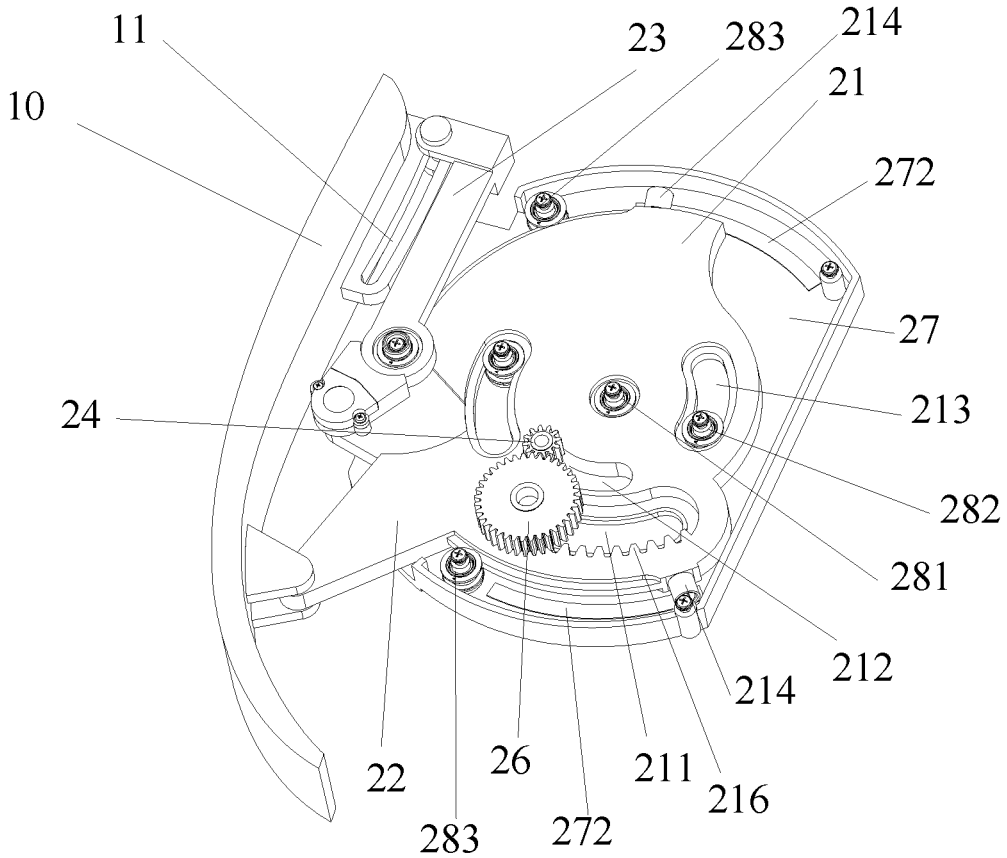
FIG. 3 shows a three-dimensional structural diagram of a movement mechanism of FIG. 1.

As shown in FIG. 1 to FIG. 3, a movement mechanism of Embodiment 1 comprises: a rotary disc 21, a first support 22 and a second support 23. The rotary disc 21 is provided rotatably, the first support 22 is fixedly provided on the rotary disc 21, and a free end of the first support 22 has a first connection portion. The second support 23 and the rotary disc 21 are hinged to a second connection portion, a first end of the second support 23 has a third connection portion, and the third connection portion is movable along a predetermined track when the rotary disc 21 rotates. The first connection portion is rotatably connected with a driven piece, and the third connection portion is movable with respect to a guide structure such as a guide groove forming the predetermined track.

By adoption of the technical solution of this embodiment, when in use, a driven piece (the driven piece is a panel 10 in this embodiment) and the movement mechanism are connected to the first connection portion and the third connection portion. The first support 22 is fixedly connected with the rotary disc, the first connection portion at a free end of the first support 22 is hinged to the panel 10, and therefore rotation of the first support 22 can push the panel 10 hinged to the first support 22 to rotatably move up and down. The second support 23 and the rotary disc 21 are hinged to the second connection portion, a first end of the second support 23 has the third connection portion, during rotation of the first support 22, the second support 23 will be driven to swing about the second connection portion serving as a rotation centre, and the third connection portion will be driven to move along the predetermined track. Thus, the panel 10 is movable along a preset movement track, so as to open and close the panel 10. The panel mechanism of Embodiment 1 enables the panel 10 to be opened and closed by means of matching of the rotary disc 21, the first support 22, the second support 23 and the panel 10. Compared with a dual-gear rack structure in the prior art, the panel mechanism of this embodiment has a simpler structure and more steadily moves.

Figure 8:
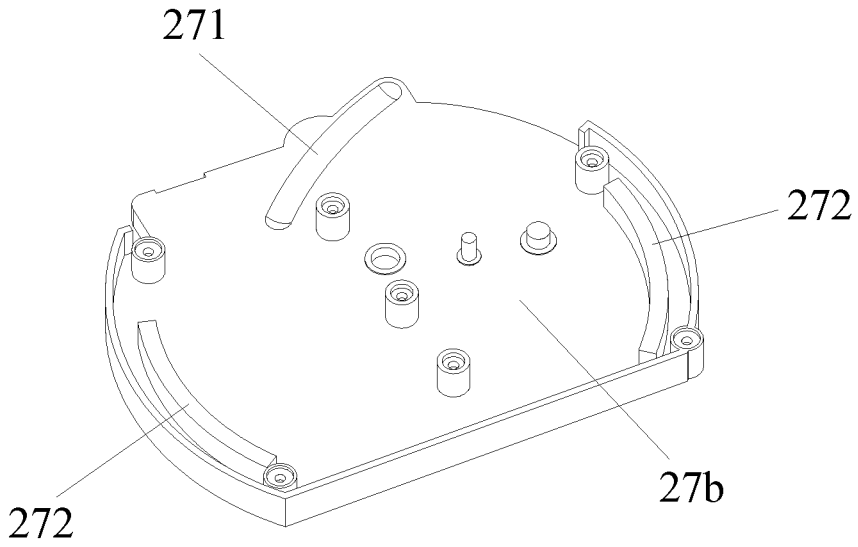
FIG. 8 shows a structural diagram of a box cover of a movement mechanism of FIG. 1.

As shown in FIG. 1 and FIG. 8, a guide piece 232*a* is provided on the second support 23. The movement mechanism further comprises a drive box. The rotary disc 21 is rotatably provided in the drive box. A first guide groove 271 is provided on the drive box, wherein the guide piece 232*a* moves in the first guide groove 271 so as to limit a movement track of the second support 23. Matching of the first guide groove 271 and the guide piece 232*a* enables the second support 23 to move in accordance with the predetermined track, thereby driving the driven piece (the panel 10) to move in accordance with the predetermined track by means of the third connection portion. In this embodiment, the guide piece 232*a* is a rolling device, and is a rolling ball preferably. The rolling device 232*a* may guide the second support 23 and may replace face-to-face sliding friction with rolling friction, so as to reduce the rotation resistance of the second support 23. Meanwhile, the swinging stability of the second support 23 may be improved.

Figure 4:
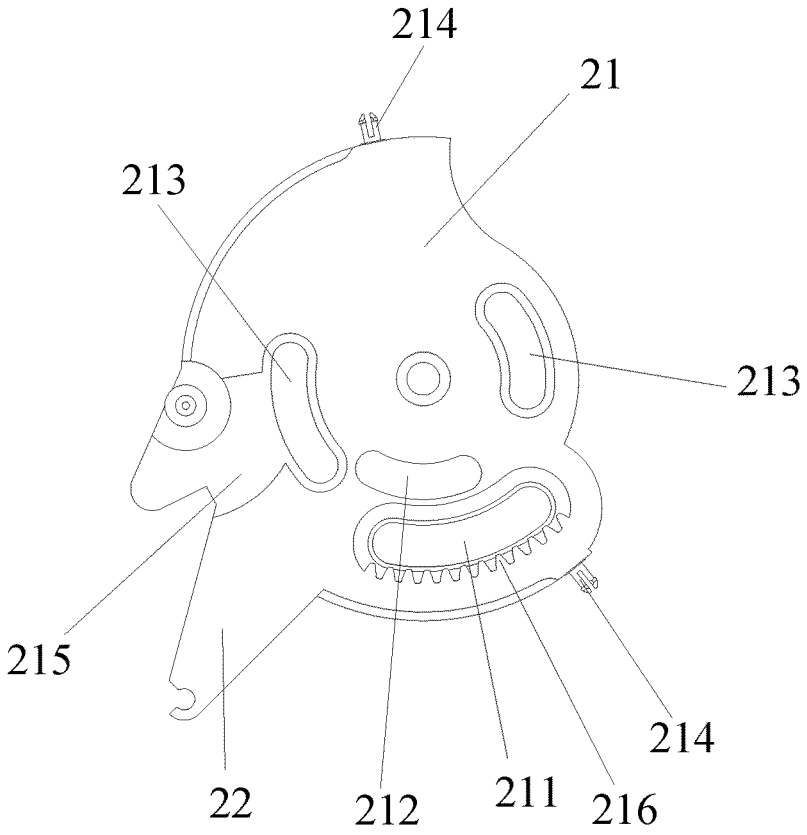
FIG. 4 shows a structural diagram of a rotary disc of a movement mechanism of FIG. 1.

As shown in FIG. 1 to FIG. 3 and FIG. 5, a second end of the second support 23 and the rotary disc 21 are hinged to the second connection portion, and the second end of the second support 23 is further provided with a balance portion 232. The second support 23 and the balance portion 232 may be of an integrated moulding structure. Preferably, one circular hole is provided at a connection position of the second support 23 and the balance portion 232, and two sides thereof are provided with one bearing gasket separately, the bearing gaskets matching a cylinder on the rotary disc 21 to form rotation fulcra of the second support 23. As shown in FIG. 4, a second guide groove 215 matching the balance portion 232 is provided on the rotary disc 21. The second guide groove 215 is configured to guide the balance portion 232, thereby improving the movement stability.

Figure 5:
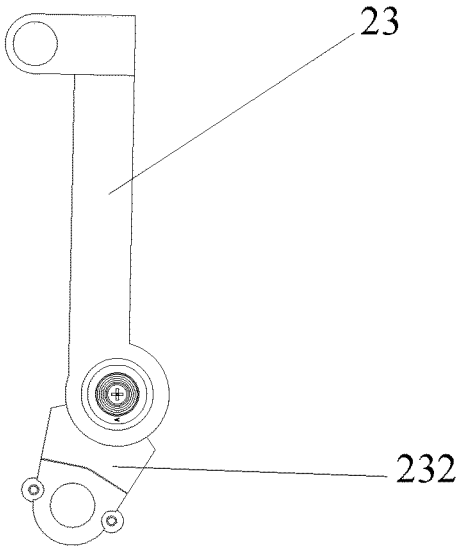
FIG. 5 shows a structural diagram of a second support of a movement mechanism of FIG. 1.

As shown in FIG. 5, an obtuse angle is formed between a central axis of the balance portion 232 and a central axis of the second support 23, such that the stability can be improved, and the rotation angle of the second support 23 is enlarged. When the panel 10 is in a closed state, the second support 23 is vertically provided, preferably.

As shown in FIG. 5, preferably, the first end of the second support 23 has a bending portion, the bending portion forming a forked structure. Two corresponding through holes are provided on two plates of the forked structure respectively, the two plates are opposite to each other. The third connection portion is provided on the bending portion. The third connection portion may be set as a rotary shaft or a pin shaft, two ends of the rotary shaft or the pin shaft being inserted into the two through holes respectively.

As shown in FIG. 3 and FIG. 4, the rotary disc 21 is fixedly provided with the first support 22. It may be implemented in a mode of integrally moulding the first support 22 and the rotary disc 21 as a whole structure. Fixing of the first support 22 to the rotary disc 21 may be implemented in a mode of screwing, bolting or riveting. Preferably, in this embodiment, the mode of integrally moulding the first support 22 and the rotary disc 21 is adopted. Integrated moulding not only improves the production efficiency of parts and reduces assembly, but also can improve the strength. The first connection portion at the free end of the first support 22 is provided with an olecranon structure, namely a notched through hole. The olecranon structure of the first connection portion is hinged to and matches the rotary shaft of the panel 10. Certainly, the matching structure is not limited thereto. It is only required that the first support 22 and the panel 10 are hinged.

Figure 6:
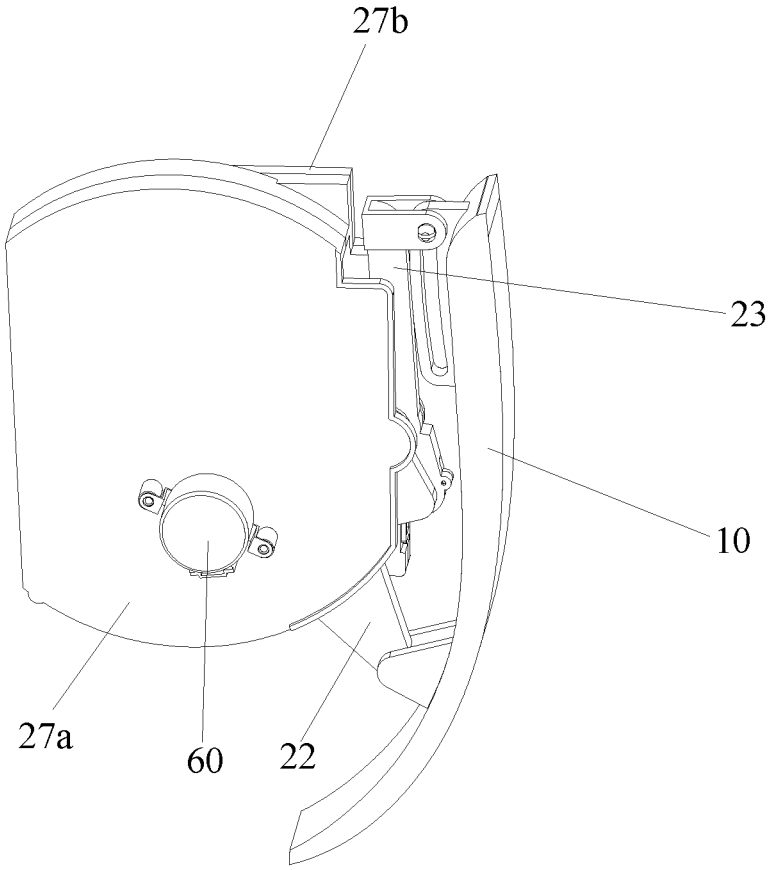
FIG. 6 shows a three-dimensional structural diagram of a movement mechanism of FIG. 1 at another angle.
Figure 7:
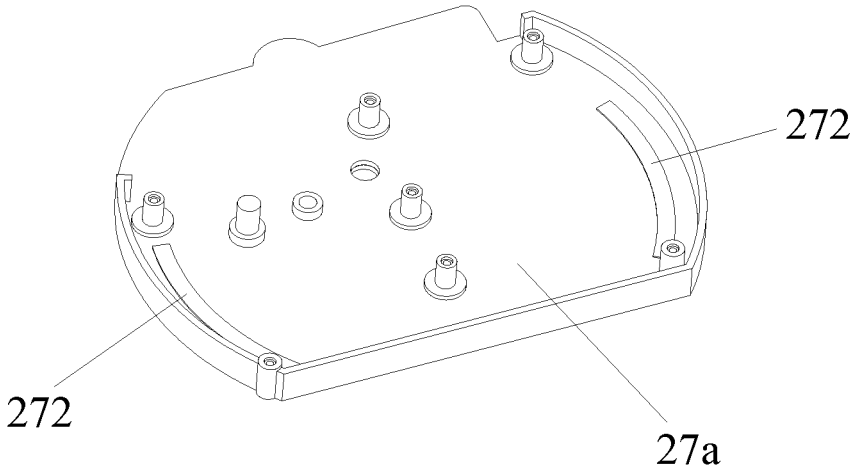
FIG. 7 shows a structural diagram of a box body of a movement mechanism of FIG. 1.

As shown in FIG. 6 to FIG. 8, the drive box comprises a box body 27*a* and a box cover 27*b* fastened mutually, which are connected in a detachable manner, preferably. The first guide groove 271 is provided on the box cover 27*b*. The rotary disc 21 is rotatably provided between the box body 27*a* and the box cover 27*b*. The above structure enables the drive box to be convenient to process, simple to assemble and easy to maintain.

As shown in FIG. 3 and FIG. 4, the rotary disc 21 has a central through hole, a first arc-shaped avoidance groove 213 and an arc-shaped edge. A central limiting shaft 281, a middle limiting shaft 282 and an edge limiting shaft 283 are provided on the box body 27*a*. The central limiting shaft 281 matches the central through hole. The middle limiting shaft 282 matches the first arc-shaped avoidance groove 213. The edge limiting shaft 283 matches the arc-shaped edge of the rotary disc 21. The rotation centre of the rotary disc 21 serves as a circle centre of the first arc-shaped avoidance groove 213. In this embodiment, there are two middle limiting shafts 282, two edge limiting shafts 283 and two first arc-shaped avoidance grooves 213, and the two first arc-shaped avoidance grooves 213 may be provided symmetrically. In order to reduce the rotation friction of the rotary disc 21, face-to-face sliding friction is replaced with rolling friction, so as to reduce the rotation resistance of the first support 22, and meanwhile, the rotation stability of the first support 22 may be guaranteed. Axle sleeves are sleeved on the central limiting shaft 281, the middle limiting shafts 282 and the edge limiting shafts 283 respectively. Certainly, there may be more than three middle limiting shafts 282, edge limiting shafts 283 and first arc-shaped avoidance grooves 213, and the number of the first arc-shaped avoidance grooves 213 needs to be adaptive to that of the middle limiting shafts 282.

In order to further reduce the friction and improve the movement stability, the rotary disc 21 comprises a rotary disc body and a supporting portion 214 provided on the periphery of the rotary disc body. The supporting portion 214 protrudes out of the rotary disc 21 in a rotation axis direction of the rotary disc body. Arc-shaped supporting convex ribs 272 matching the supporting portion 214 are provided on the box body 27*a* and/or the box cover 27*b*. The supporting portion 214 and the arc-shaped supporting convex ribs 272 match each other so as to support the rotary disc body away from the box body 27*a* and/or the box cover 27*b*. That is, the supporting portion 214 can support the rotary disc 21, thereby avoiding contact between the whole surface of the rotary disc 21 and the drive box, and reducing the friction. Preferably, the supporting portion 214 may be provided as a rotary shaft rotatably connected with the rotary disc 21, or may be fixedly connected with the rotary disc 21 and sheathed externally by an axle sleeve.

The rotary disc 21 may be directly driven by a motor. Or, as shown in FIG. 3, FIG. 4 and FIG. 6, a transmission rack 216 is provided on the rotary disc 21. The movement mechanism further comprises a motor 60 and a transmission mechanism provided between the motor and the rotary disc 21. The motor 60 drives the rotary disc 21 by means of the transmission mechanism. The transmission mechanism comprises a speed-reducing gear set, the transmission rack 216 matches the speed-reducing gear set, and the motor 60 drives the transmission mechanism so as to drive the rotary disc 21 to rotate. Preferably, the speed-reducing gear set comprises a first gear 24 and a second gear 25 driven by the first gear 24. The first gear 24 is mounted on an output shaft of the motor, the first gear 24 is a driving gear, the second gear 25 is meshed with the transmission rack, and the second gear 25 is a driven gear. The radius of the first gear 24 is smaller than that of the second gear 25. In order to increase the torque of the motor and miniaturize the motor, the speed-reducing gear set further comprises a third gear 26 which is coaxial with or integrated with the second gear 25, the third gear 26 and the second gear 25 rotating synchronously. The third gear 26 is meshed with the first gear 24, and the radius of the third gear 26 is greater than that of the second gear 25, and the third gear 26 is a speed reducing gear. Thus, the torque of the motor is increased by speed reduction, and transmission is performed by means of the second gear 25. The radius of the third gear 26 is greater than that of the second gear 25, so the tooth profile of the second gear 25 is smaller than that of the third gear, and therefore the rotation will be more stable.

The transmission rack 216 may be provided on the surface of the rotary disc 21. Or preferably, in order to make the occupation space smaller, the rotary disc 21 has an arc-shaped drive groove 211, the transmission rack 216 is provided in the arc-shaped drive groove 211, and the second gear 25 rotates in the arc-shaped drive groove 211.

The rotary disc 21 has a second arc-shaped avoidance groove 212 avoiding the output shaft of the motor. The arc-shaped drive groove 211 and the second arc-shaped avoidance groove 212 are independent of each other, or the arc-shaped drive groove 211 and the second arc-shaped avoidance groove 212 are communicated with each other. The circle centres of the arc-shaped drive groove 211 and the second arc-shaped avoidance groove 212 adopt the rotation centre of the rotary disc 21.

The movement process of the movement mechanism will be introduced below in conjunction with FIG. 1 to FIG. 5. The specific introductions are as follows.

When the driven piece needs to be moved, the motor drives the first gear 24 to rotate, and the first gear 24 drives the third gear 26 meshed therewith to rotate. The second gear 25 and the third gear 26 are coaxially or integrally provided, such that the second gear 25 and the third gear 26 may synchronously rotate, so as to drive the transmission rack meshed with the second gear 25 to move, thus the rotary disc 21 will be driven to rotate around the rotation centre. The rotation of the rotary disc 21 can drive the first support 22 to rotate, thus, rotation of the first support 22 can push the driven piece to rotatably move up. When the first support 22 rotates, the second support 23 will be driven to swing about the second connection portion serving as the rotation centre, and the third connection portion will be driven to move along the predetermined track. Thus, the driven piece is movable along the preset movement track.

When the driven piece needs to be reset, the motor rotates reversely, the rotary disc 21 is driven to rotate reversely, and the first support 22 and the second support 23 return to initial positions. A closed process is an inverse process of an open process, which will not be elaborated.

As shown in FIG. 9 to FIG. 13, different from the movement mechanism of Embodiment 1, the movement mechanism of Embodiment 2 further comprises a connection piece 50. A first guide groove 51 is provided on the connection piece 50 so as to form a predetermined track. A specific structure of the first guide groove 51 is designed according to the expected movement track of the driven piece. The first guide groove 51 is an elongated hole, preferably. The first end of the second support 23 is provided with a first matching portion sliding or rolling in the first guide groove 51, so as to form the third connection portion. The connection piece 50 is further provided with a hinging portion 52 hinging the free end of the first support 22 to the first connection portion. Sliding friction or rolling friction exists between the first matching portion and the first guide groove 51. Preferably, the first matching portion is a connection column and an axle sleeve sleeved on the connection column. By mounting the axle sleeve in the first guide groove 51, the axle sleeve rolls in the first guide groove 51. Two ends of the first matching portion penetrate into the two through holes respectively, and the first matching portion may move in the first guide groove 51.

Figure 10:
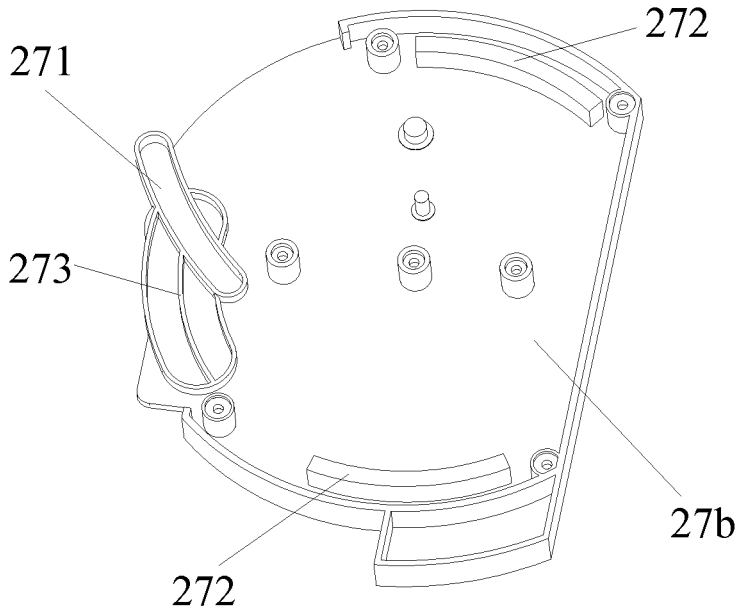
FIG. 10 shows a structural diagram of a box cover of a movement mechanism of FIG. 9.

As shown in FIG. 10, different from the movement mechanism of Embodiment 1, the movement mechanism of Embodiment 2 further comprises limiting ribs 273 protruding out of the drive box and corresponding to the second support 23, the limiting ribs being configured to limit movement of the second support in a direction vertical to a rotation plane thereof. The limiting ribs 273 are located on two sides of the first guide groove 271. The limiting ribs 273 can prevent the second support 23 from shaking leftwards and rightwards in a movement process, thereby effectively improving the movement stability.

Figure 11:
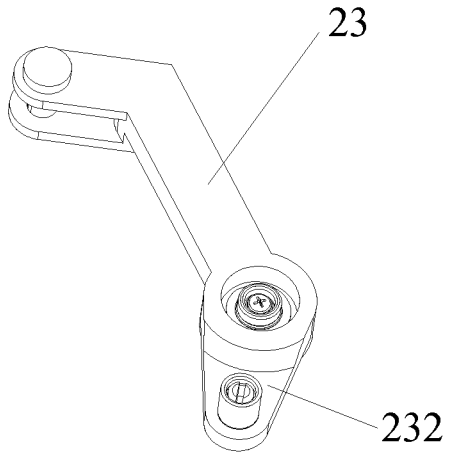
FIG. 11 shows a structural diagram of a second support of a movement mechanism of FIG. 9.
Figure 12:
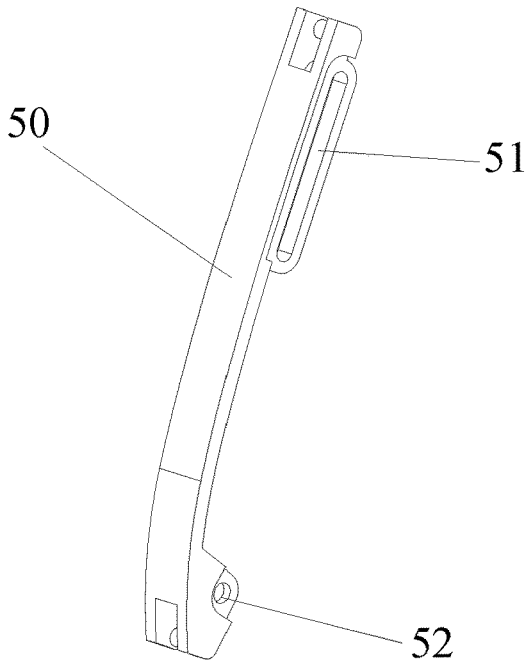
FIG. 12 shows a three-dimensional structural diagram of a connection piece of a movement mechanism of FIG. 9.
Figure 13:
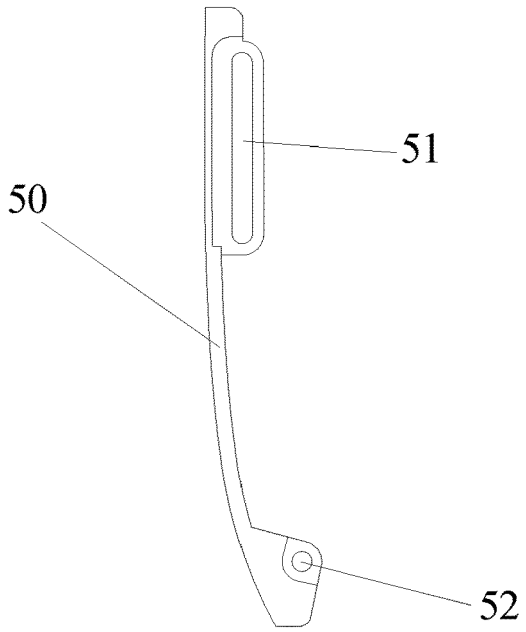
FIG. 13 shows a front view diagram of a connection piece of FIG. 12.

As shown in FIG. 11, different from the movement mechanism of Embodiment 1, in the movement mechanism of Embodiment 2, the guide piece 232*a* is a guide shaft or comprises a guide shaft and an axle sleeve sleeved outside the guide shaft. Preferably, the axial direction of the guide shaft is vertical to the rotary disc and the rotation plane of the rotary disc.

As shown in FIG. 1, the invention also provides a panel mechanism. The panel mechanism according to an embodiment of the invention comprises a panel 10 and a movement mechanism matching the panel 10, the movement mechanism being the movement mechanism of Embodiment 1.

In the panel mechanism of this embodiment, as shown in FIG. 1 to FIG. 3, a second guide groove 11 is provided on the panel 10 so as to form a predetermined track. A specific structure of the second guide groove 11 is designed according to the expected movement track of the panel. The second guide groove 11 is an elongated hole, preferably. A first end of a second support 23 is provided with a second matching portion 231 so as to form a third connection portion which matches the second guide groove 11 and may move with respect to the second guide groove 11. The panel 10 and a free end of a first support 22 are connected with a first connection portion. Sliding friction or rolling friction exists between the second matching portion 231 and the second guide groove 11. Preferably, the second matching portion 231 is a connection column and an axle sleeve sleeved on the connection column. By mounting the axle sleeve in the second guide groove 11, the axle sleeve rolls in the second guide groove 11. Two ends of the second matching portion 231 penetrate into two through holes respectively, and the second matching portion 231 may move in the second guide groove 11.

Figure 9:
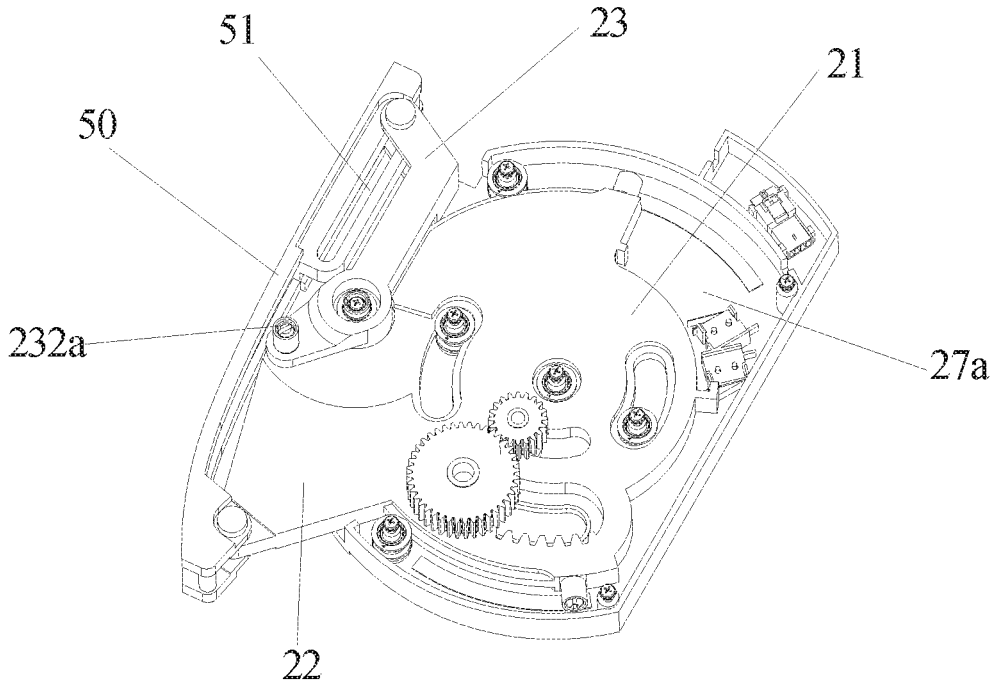
FIG. 9 shows a partial structure diagram of a movement mechanism at a closed position according to an embodiment 2 of the invention.

As shown in FIG. 9, the invention also provides a panel mechanism. The panel mechanism according to an embodiment of the invention comprises a panel 10 and a movement mechanism matching the panel 10, the movement mechanism being the movement mechanism of Embodiment 2. In this embodiment, the panel 10 is detachably connected with a connection piece 50. In the panel mechanism of this embodiment, the panel 10 is detachably connected with the connection piece 50, so as to more facilitate subsequent repairing or cleaning.

Figure 14:
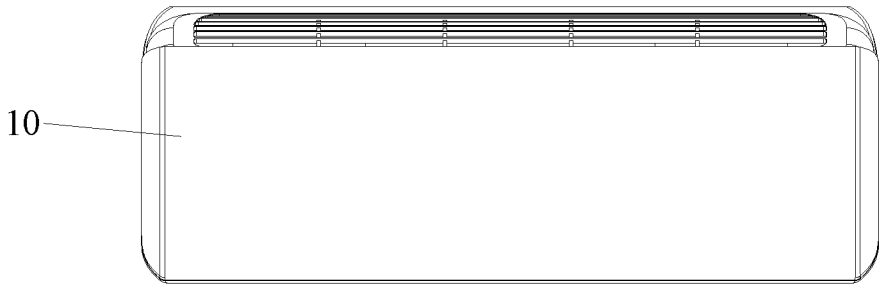
FIG. 14 shows a structural diagram of a panel mechanism of an air conditioner at a closed position according to the invention.
Figure 15:
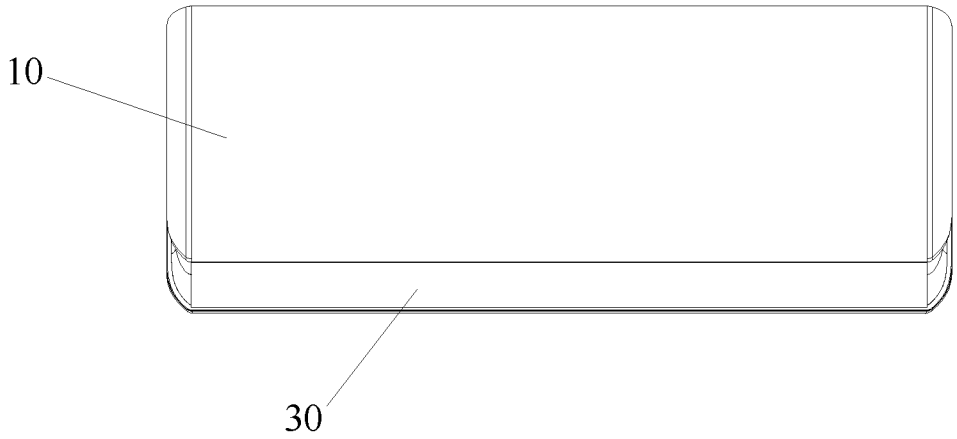
FIG. 15 shows a structural diagram of a panel mechanism of an air conditioner of FIG. 14 at an open position.
Figure 16:
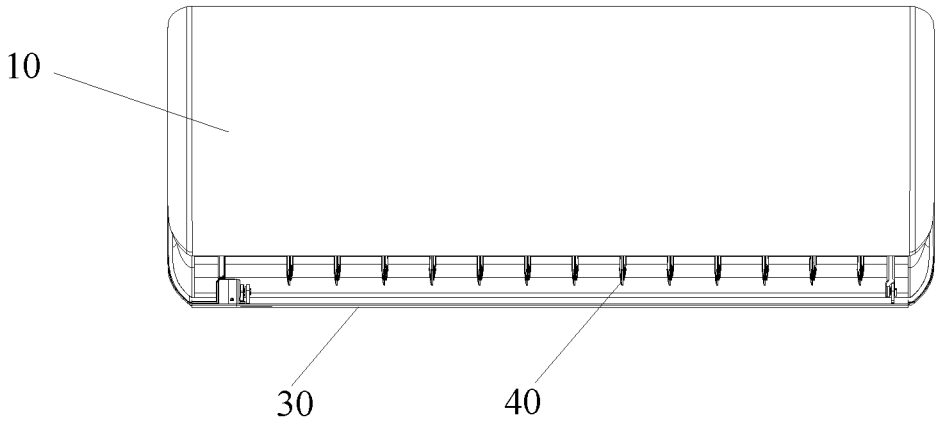
FIG. 16 shows a structural diagram of a panel mechanism and air deflector of an air conditioner of FIG. 14 at an open position.

The invention also provides a household appliance. The household appliance according to an embodiment of the invention has a housing and a panel mechanism mounted on the housing, the panel mechanism being the above movement mechanism. As shown in FIG. 14 to FIG. 16, the household appliance is an air conditioner, and the air conditioner further comprises a motor, an air deflector 30 and an air sweeping blade 40. The motor drives a panel 10 by means of a movement mechanism, such that the panel 10 has a closed position (state shown in FIG. 14) covering an outer side of the air deflector 30 and an open position (state shown in FIG. 15) exposed from the air deflector 30. After the panel is exposed from the air deflector 30, the air deflector 30 may be opened downwards, and the air sweeping blade 40 is exposed to sweep air (state shown in FIG. 16).

Certainly, the panel mechanism is not limited to be used in the air conditioner, and may be used in other household appliances of which panels need to be opened.

The above is only the preferred embodiments of the invention, and is not intended to limit the invention. There may be various modifications and variations in the invention for those skilled in the art. Any modifications, equivalent replacements, improvements and the like within the spirit and principle of the invention shall fall within the protective scope of the invention.

The invention claimed is:

1. A movement mechanism, comprising:

a rotary disc, provided rotatably, a first support is fixedly provided on the rotary disc, and a free end of the first support having a first connection portion; and a second support, the second support and the rotary disc being hinged to a second connection portion, a first end of the second support having a third connection portion, and the third connection portion being movable along a predetermined track when the rotary disc rotates;

a transmission rack is provided on the rotary disc, the movement mechanism further comprises a motor and a transmission mechanism, the motor drives the transmission mechanism, the transmission mechanism comprises a speed-reducing gear set, the transmission rack matches the speed-reducing gear set, and the motor drives the transmission mechanism so as to drive the rotary disc to rotate.

2. The movement mechanism according to claim 1, wherein a guide piece is provided on the second support; the movement mechanism further comprises a drive box; the rotary disc is rotatably provided in the drive box; and a first guide groove is provided on the drive box, wherein, the guide piece moving in the first guide groove so as to limit a movement track of the second support.

3. The movement mechanism according to claim 2, wherein the guide piece is a rolling device or a guide shaft or comprises a guide shaft and an axle sleeve sleeved outside the guide shaft.

4. The movement mechanism according to claim 2, wherein a second end of the second support is further provided with a balance portion, the guide piece is provided on the balance portion.

5. The movement mechanism according to claim 4, wherein a second guide groove matching with the balance portion is provided on the rotary disc (21).

6. The movement mechanism according to claim 2, wherein the drive box comprises a box body and a box cover fastened mutually, and the first guide groove is provided on the box cover.

7. The movement mechanism according to claim 6, wherein a central through hole is provided at a rotation centre position of the rotary disc, and a central limiting shaft matching the central through hole is provided on the box body.

8. The movement mechanism according to claim 6, wherein a middle limiting shaft is provided on the box body, the rotary disc has a first arc-shaped avoidance groove matching the middle limiting shaft, and a circle centre of the first arc-shaped avoidance groove is concentric with a rotation centre of the rotary disc.

9. The movement mechanism according to claim 6, wherein the rotary disc is provided with an arc-shaped edge, a circle centre of the arc-shaped edge is concentric with a rotation centre of the rotary disc, an edge limiting shaft is provided on the box body, and the edge limiting shaft matches the arc-shaped edge of the rotary disc.

10. The movement mechanism according to claim 6, wherein the rotary disc comprises a rotary disc body and a supporting portion provided on a periphery of the rotary disc body, arc-shaped supporting convex ribs are provided on the box body and/or the box cover, and the supporting portion and the arc-shaped supporting convex ribs match each other so as to support the rotary disc body away from the box body and/or the box cover.

11. The movement mechanism according to claim 2, further comprising a limiting rib protruding out of the drive box and corresponding to the second support, the limiting rib being configured to limit movement of the second support in a direction vertical to a rotation plane thereof.

12. The movement mechanism according to claim 1, wherein the speed-reducing gear set comprises a first gear and a second gear driven by the first gear, the radius of the first gear is smaller than that of the second gear, the first gear is mounted on an output shaft of the motor, and the second gear is meshed with the transmission rack.

13. The movement mechanism according to claim 12, wherein the speed-reducing gear set further comprises a third gear which is coaxial with or integrated with the second gear, the third gear and the second gear rotating synchronously; the third gear is meshed with the first gear; and the radius of the second gear is smaller than that of the third gear.

14. The movement mechanism according to claim 12, wherein the rotary disc has an arc-shaped drive groove, a circle centre of the arc-shaped drive groove is concentric with a rotation centre of the rotary disc, the transmission rack is provided in the arc-shaped drive groove, and the second gear rotates in the arc-shaped drive groove.

15. The movement mechanism according to claim 14, wherein the rotary disc also has a second arc-shaped avoidance groove avoiding the motor, the arc-shaped drive groove and the second arc-shaped avoidance groove are independent of each other, or the arc-shaped drive groove and the second arc-shaped avoidance groove are communicated with each other.

16. The movement mechanism according to claim 1, further comprising a connection piece, a first guide groove is provided on the connection piece so as to form the predetermined track, the first end of the second support is provided with a first matching portion sliding or rolling in the first guide groove, the first matching portion forms the third connection portion, and the connection piece is further provided with a hinging portion hinging the free end of the first support to the first connection portion.

17. A panel mechanism, comprising a panel and a movement mechanism matching the panel, wherein the movement mechanism is the movement mechanism according to claim 1, a second guide groove is provided on the panel so as to form the predetermined track, the first end of a second support is provided with a second matching portion sliding or rolling in the second guide groove, the second matching portion forms the third connection portion, and the panel and the free end of a first support are hinged to the first connection portion.

18. A household appliance, comprising a housing and a panel mechanism mounted on the housing, wherein the panel mechanism is the movement mechanism according to claim 17, the household appliance is an air conditioner, the air conditioner further comprises an air deflector, and a panel has a closed position covering an outer side of the air deflector and an open position exposed from the air deflector.

* * * * *